US006250735B1

(12) United States Patent
Kaneko et al.

(10) Patent No.: US 6,250,735 B1
(45) Date of Patent: Jun. 26, 2001

(54) COVER FOR PRINT HEAD ALIGNMENT SENSOR

(75) Inventors: Masanori Kaneko, Fountain Valley; Makoto Takemura, Irvine, both of CA (US)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/019,309

(22) Filed: Feb. 5, 1998

(51) Int. Cl.[7] ..... B41J 2/01
(52) U.S. Cl. ..... 347/19; 347/37
(58) Field of Search ..... 347/37, 19, 29; 358/504, 406

(56) References Cited

U.S. PATENT DOCUMENTS

| | | | | |
|---|---|---|---|---|
| 3,672,284 | * | 6/1972 | Schwarz . | |
| 4,692,778 | | 9/1987 | Yoshimura et al. | 346/145 |
| 5,090,827 | | 2/1992 | Hirano et al. | 400/185 |
| 5,258,773 | | 11/1993 | Arakawa et al. . | |
| 5,266,974 | | 11/1993 | Koitabashi et al. . | |
| 5,350,929 | * | 9/1994 | Meyer et al. | 250/573 |
| 5,353,052 | | 10/1994 | Suzuki et al. | 347/19 |
| 5,363,124 | * | 11/1994 | Arway | 347/74 |
| 5,416,395 | | 5/1995 | Hiramatsu | 318/600 |
| 5,451,990 | * | 9/1995 | Sorenson et al. | 347/37 |
| 5,495,271 | | 2/1996 | Koitabashi et al. | 347/23 |
| 5,512,926 | | 4/1996 | Uchikata et al. | 347/86 |
| 5,534,899 | | 7/1996 | Uchikata et al. | 347/49 |
| 5,670,997 | | 9/1997 | Sugimoto et al. | 347/30 |
| 5,671,000 | | 9/1997 | Hirabayashi et al. | 347/86 |
| 5,682,186 | * | 10/1997 | Bohorquez et al. | 347/29 |
| 5,798,777 | * | 8/1998 | Yoshimura et al. | 347/44 |

* cited by examiner

*Primary Examiner*—John Barlow
*Assistant Examiner*—Craig A. Hallacher
(74) *Attorney, Agent, or Firm*—Fitzpatrick, Cella, Harper & Scinto

(57) ABSTRACT

A cover for an alignment sensor that provides sensor output so as to align printer output from multiple print heads in an ink jet printer. The cover is preferably mounted for hinged movement between an open position and a closed position so that a sensing face of the alignment sensor is protected from ink mist during printing operations. A chassis of the printer may be provided with projections that engage with the cover when the carriage is moved to extreme rightward and leftward positions on the printer, so that the cover may be hinged to the open and closed position simply through movement of the printer carriage. Preferably, the cover is formed of an electrically conductive material with a tab that grounds the cover to a metallic portion of the printer chassis. Forming the cover from an electrically conductive material provides the additional benefit of protecting the alignment sensor from static discharge.

15 Claims, 5 Drawing Sheets

COVER FOR PRINT HEAD ALIGNMENT SENSOR

BACKGROUND OF THE INVENTION

1. Field of the Invention

The present invention relates to ink jet printers having multiple print heads, and more particularly to a cover for an alignment sensor that facilitates alignment of one of the multiple heads to others of the multiple heads.

2. Description of the Related Art

Ink jet printers have become an extremely popular format for achieving high quality computer printout at low cost. Ink jet printers form a printed image by ejecting small ink droplets from a print head in predetermined patterns onto a recording medium. The print head is mounted on a moveable carriage which provides right and left reciprocal movement at high scanning speeds across the width of the recording medium, while the recording medium is slowly fed in the lengthwise direction.

Recently-introduced ink jet printers have multiple print heads, such as two or more print heads mounted on the reciprocating carriage. The print heads may be identical to each other, such as a dual black or dual color print heads which increase black and white or color printout speeds by up to a factor of two. Alternatively, the print heads may differ from each other, such as a black print head paired with a color print head which provides good color reproduction without sacrificing print speed for black and white documents. As a further example, some ink jet printers are equipped with one full color print head paired with a photographic-density color print head, so as to achieve high quality photographic-like printout.

One complication introduced by providing ink jet printers with multiple print heads is the need to align printout for one of the multiple print heads to all others of the multiple print heads. Without alignment, mechanical manufacturing tolerances would cause printout from one print head to be mismatched relative to printout from others of the print heads.

Some existing multiple head ink jet printers utilize a manual alignment technique in which predetermined patterns are printed and the computer user is asked to respond to questions concerning quality and appearance of the printout. Such techniques are not generally satisfactory, in that they cause needless user confusion, result in inconsistent alignment accuracy, and inevitably complicate the printer.

The assignee of the present application has recently described a technique for automatic alignment of multiple print heads in an ink jet printer, in which an alignment sensor is mounted on the carriage together with the multiple print heads. According to this technique, automatic alignment is achieved through printout of predetermined patterns, automatic sensing of printout results, and calculation of alignment parameters. See U.S. application Ser. No. 08/901,560, "Auto-Alignment System For A Printing Device", the contents of which are incorporated herein by reference as if set forth in full.

One problem encountered in auto alignment techniques results from a back spray, or ink mist, that forms during the print process. Specifically, because the alignment sensor must be mounted in close proximity to the ink jet print heads, any ink mist that forms during the printing process tends to settle on the alignment sensor's face, obscuring light transmissivity and prevent accurate alignment.

SUMMARY OF THE INVENTION

It is an object the invention to address the foregoing difficulty by providing a cover for an alignment sensor that is mounted on the printer carriage.

In one aspect, a cover for an alignment sensor is mounted in hinged relation to a printer carriage that carries multiple print heads. The cover is hingedly moveable from an open position during auto alignment sensing operations, to a closed position during standard printing operations. Hinged movement of the cover is preferably obtained through movement of the printer carriage, so that the cover is hinged to the open position by movement of the carriage to one extreme edge of carriage reciprocation, and is hinged to the closed position by movement to the opposite extreme edge. Means are preferably provided on the cover, with complementary means provided on the carriage, to retain the cover in the open or closed position.

By virtue of the cover, ink mist formed during printing operations does not become deposited on the light receiving face of the alignment sensor. Accordingly, accurate alignment sensing is insured, without diminished operation over the life of the printer. In addition, the cover preferably is formed with an enclosing skirt, which during alignment sensing operation acts as a shield to shield the alignment sensor from any ambient light. The light shielding operation of the cover's skirt increases accuracy of alignment results.

In further aspects of the invention, the cover provides static charge protection for the alignment sensor by forming the cover from an electroconductive material such as carbon-impregnated plastic. A grounding flap projects from an edge of the cover, with the grounding flap being in close but non-contacting proximity to a metallic element of the printer chassis. Preferably, the projecting flap projects from the rear of the cover so that it is adjacent a metallic carriage support rod upon which the carriage reciprocates from right to left to effect printout.

Because the cover is formed from electrically conductive material, the possibility of static damage to the alignment sensor is lessened, since any static charge will be dissipated to surrounding regions rather than damaging the alignment sensor. Moreover, because the projecting flap is in non-contacting close adjacency to the chassis, static charge can be dissipated to the chassis without impeding mechanical movement of the carriage.

This brief summary has been provided so that the nature of the invention may be understood quickly. A more complete understanding of the invention can be obtained by reference to the following detailed description of preferred embodiments thereof in connection with the attached drawings.

DETAILED DESCRIPTION OF THE PREFERRED EMBODIMENTS

Figure 1:
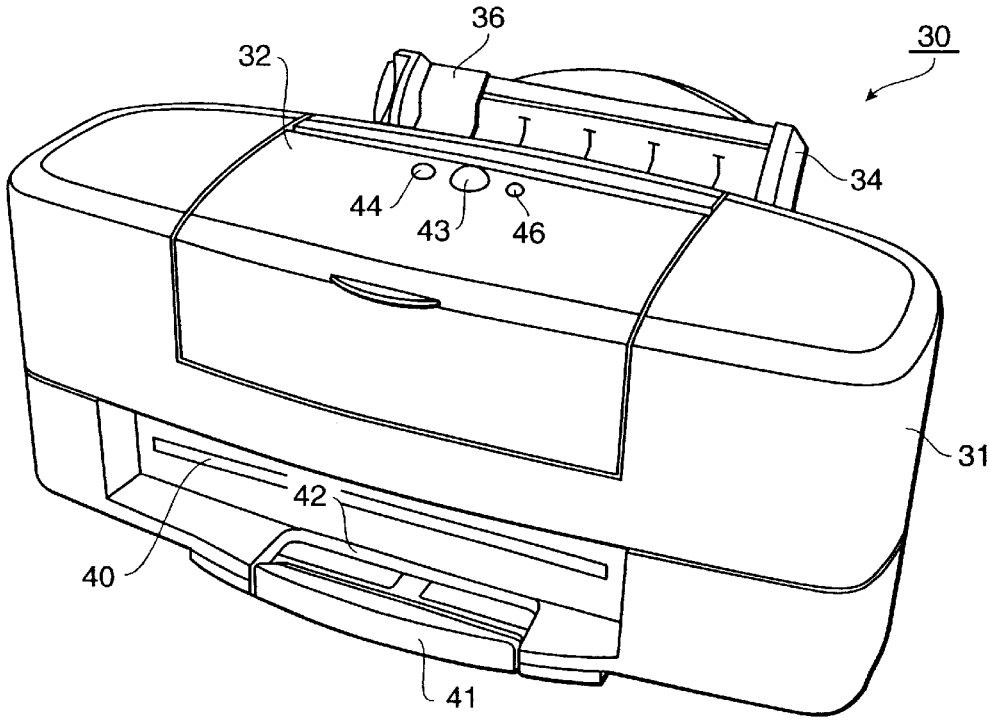
FIG. 1 is a front perspective view of a printer according to the invention.
Figure 2:
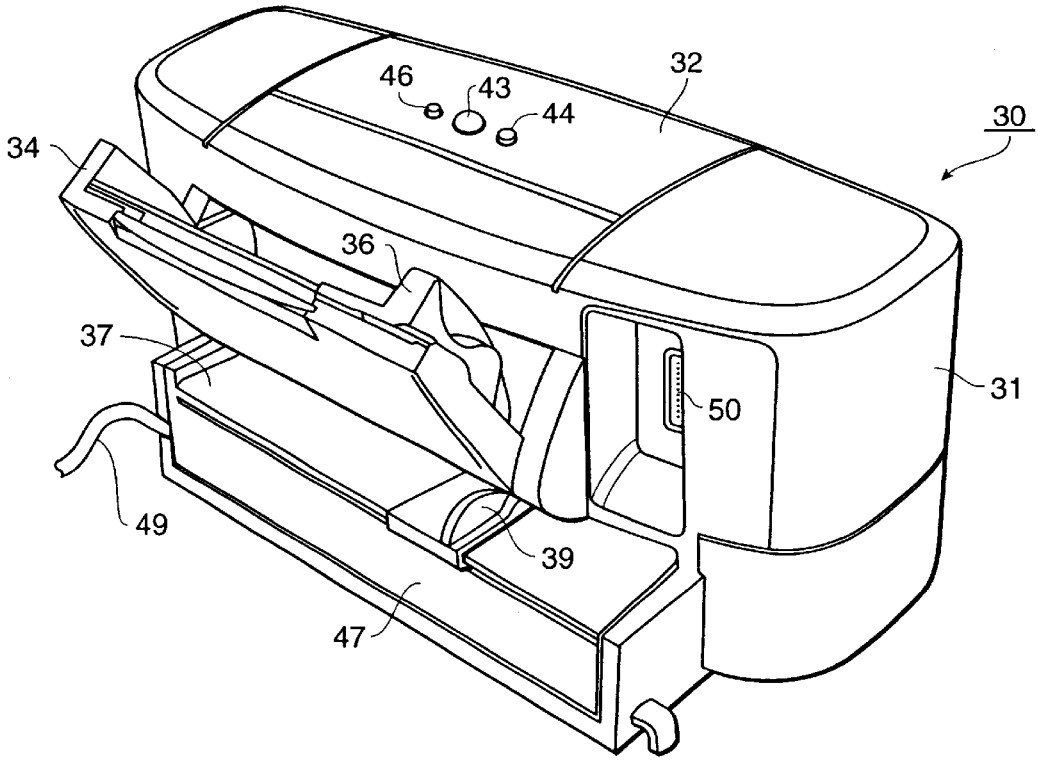
FIG. 2 is a rear perspective view of a printer according to the invention.
Figure 3:
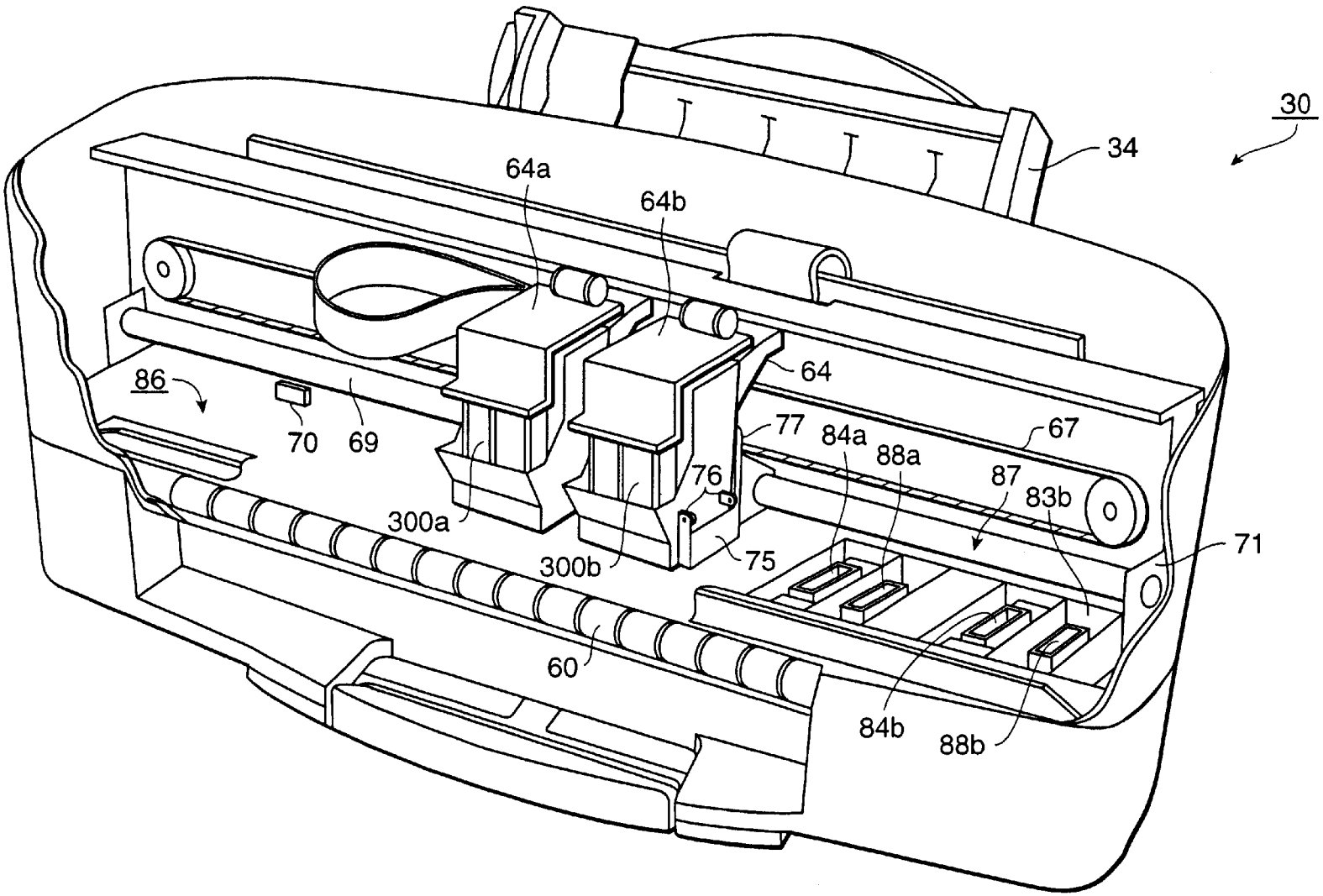
FIG. 3 is a cutaway front perspective view of a printer according to the invention, showing a cover for an alignment sensor in a closed position.

FIGS. 1 and 2 are perspective front and back views, respectively, of printer 30 incorporating an alignment cover according to the invention, and FIG. 3 is a cutaway perspective view thereof. With the exception of the alignment cover and related materials and processes, printer 30 is similar to that described in application Ser. No. 08/972,139, "Ejection Tray For A Printer", the contents of which are incorporated herein by reference as if set forth in full.

As shown in FIGS. 1 and 2, printer 30 includes housing 31, cover 32, automatic feeder 34, automatic feed width adjuster 36, manual feeder 37 to accept wide-format or thick recording media, manual feed width adjuster 39, media eject port 40, ejection tray 41, tray receptacle 42, indicator light 43, power button 44, resume (on/off line) button 46, power supply 47, power cord 49 and parallel port connector 50 for connection of printer 30 to a host computer via a bi-directional communication interface.

Cover 32 is manually openable by a user so as to permit the user to access the interior of printer 30 such as when it is desired to service or replace print heads within printer 30. Preferably, printer 30 senses when cover 32 has been opened, and in response moves the carriage carrying the print heads to a central position of the printer so as to facilitate access to the print heads. It is during such access and servicing operations that the print head is prone to static discharge damage.

Automatic feeder 34 defines a media feed position of printer 30 for up to standard-width print media. Automatic feeder 34 accommodates a stack of recording media and feeds individual sheets from the stack through printer 30 for printing on the medium during reciprocal left and right movement of the print carriage.

Manual feeder 37, which also can feed individual sheets of standard width and weight print media, is provided to accommodate wide-width media or thick non-standard media, such as transparencies, fabric, card stock and the like.

Referring specifically to FIG. 3, which shows a perspective cutaway front view of printer 30, printer 30 includes rollers 60 for feeding media from either automatic feeder 34 or manual feeder 37 through printer 30 to media ejection port 40. Removable dual print heads 300*a* and 300*b* are mounted on carriage 64 at each of stations 64*a* and 64*b*. Carriage 64 is mounted for reciprocal left and right movement on carriage guide rod 69, and carriage 64 is reciprocally driven across guide rod 69 by belt 67 and an unshown carriage drive motor. Carriage 64 can be driven from an extreme leftward position generally indicated at 86, which is outside of a carriage reciprocation area during normal (standard or wide width) print operations, to an extreme rightward position indicated generally by 87, which is also outside of carriage reciprocation operation during normal printing. Position 87 is also referred to as the "home" position, and includes a pair of ink ejection stations 84*a* and 84*b*, a pair of wiping blades 83*a* and 83*b* for wiping the face of the print heads to remove ink residue, and a pair of ink capping stations 88*a* and 88*b*, each for respective ones of print heads 300*a* and 300*b*.

Figure 4:
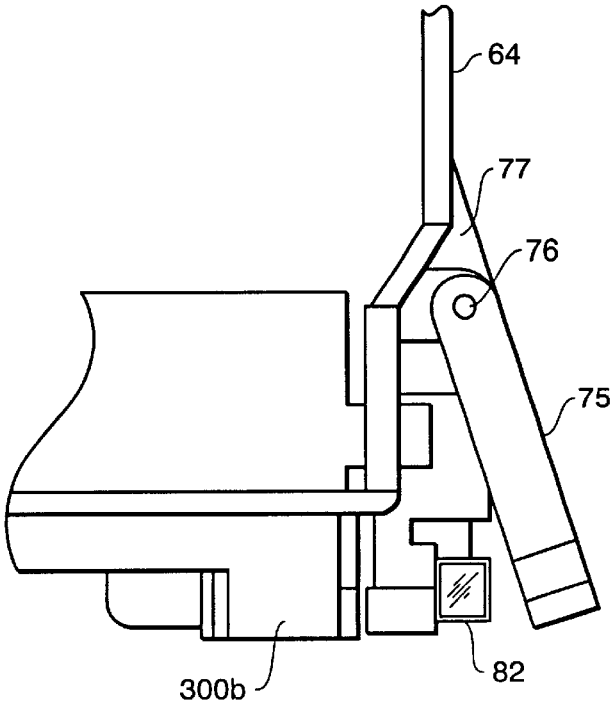
FIGS. 4 and 5 are front and rear closeup views, respectively, of the cover mounted on a printer carriage.
Figure 5:
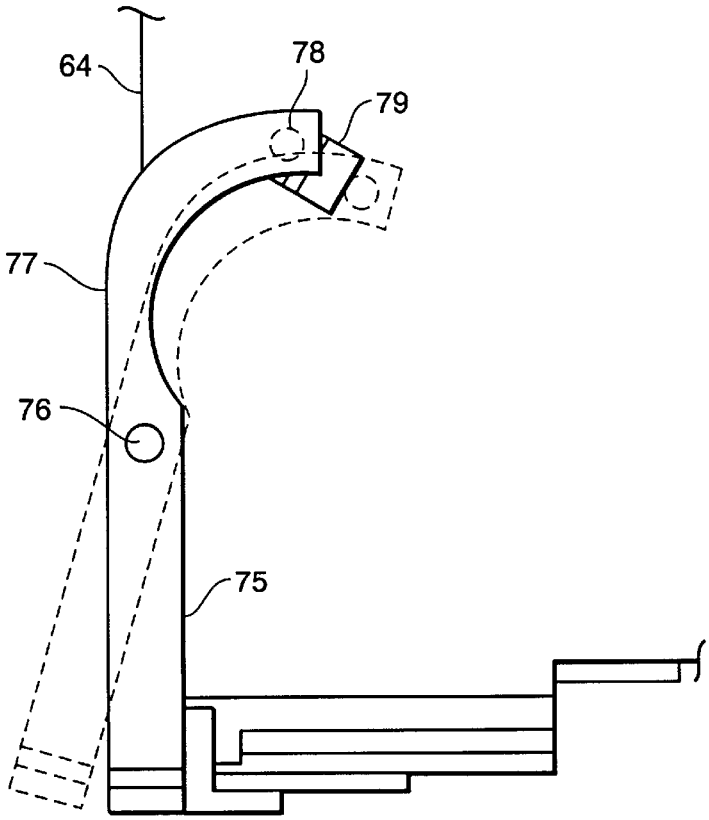

Hingedly mounted on carriage 64 is alignment sensor cover 75. In FIG. 3, cover 75 is shown in the closed position in which it protects an auto alignment sensor 82 (which is shown in FIG. 4) from ink mist and static discharge. Cover 75 is mounted by hinges 76 to carriage 64, and includes a finger 77 that terminates in a button 78 (which is shown in FIG. 5). The button cooperates with complementary structure, such as a detent or a rib, on the rear of carriage 64, so as to retain the cover in the open or closed positions, as appropriate.

Hinges 76 permit cover 75 to be hinged between an open position or a closed position. To hinge the cover to the open position, upstanding tab 70 is provided at area 86. When carriage 64 is moved to extreme area 86, tab 70 engages with a lower surface of cover 75 so as to hinge the cover outwardly to the open position. Thereafter, to hinge the cover inwardly to a closed position, carriage 64 is moved to area 87 where a corner 71 of the printer chassis hinges the cover back to a closed position.

FIG. 4 is a closeup front view showing cover 75 hinged in an open position relative to carriage 64. In the open position, alignment sensor 82 is able to sense predetermined printing patterns on a recording medium so as to perform automatic alignment of print heads 300*a* and 300*b*, as described in the aforementioned Ser. No. 08/901,560. Preferably, a small light source such as an LED operating in the visible light region is provided adjacent alignment sensor 82, so as to illuminate the predetermined alignment pattern printed on the recording medium, thereby to facilitate the alignment process. Alignment sensor 82 includes a sensing face that is mounted in the downward direction so that the alignment sensor can sense the predetermined printed alignment pattern printed by the multiple print heads. Cover 75 includes a lower lid 83*a* (shown in FIG. 7) that in the closed position of the cover protects the sensor face, and that in the open position is moved away from the sensor face so that alignment sensor 82 can perform a sensing operation.

FIG. 5 is a rearward closeup view of cover 75 shown in solid lines in a closed position and in dotted lines in an open position. As mentioned in connection with FIG. 3, finger 77 terminates in button 78, which cooperates with rib 79 projecting outwardly from the rear of carriage 64. Finger 77 is preferably somewhat flexible, so as to allow button 78 to flex outwardly and inwardly over rib 79 as cover 75 hinges between the open and closed position. Cooperation between button 78 and rib 79 retains the cover in the open or closed position until hinging action is forcibly performed through movement of carriage 64 to extreme positions 86 or 87.

Figure 6:
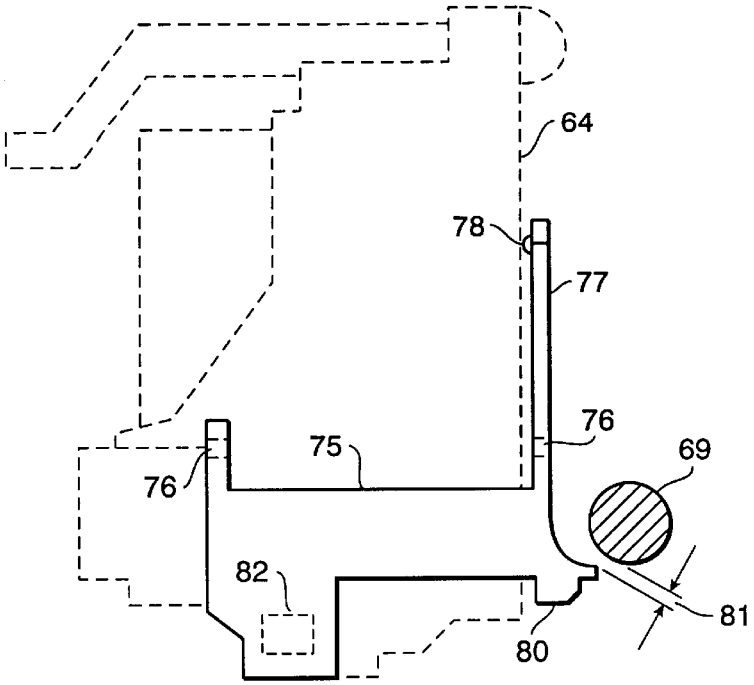
FIGS. 6 and 7 are end perspective views of the cover shown in the closed and the open position, respectively.
Figure 7:
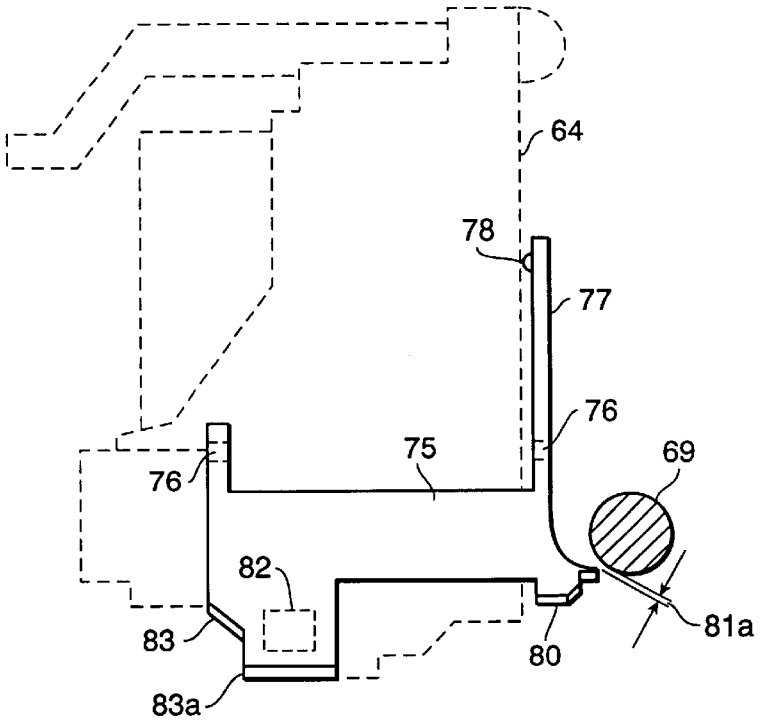

Preferably, cover 75 is formed of an electrically conductive material such as carbon-impregnated plastic, so as to dissipate a static charge and to protect alignment sensor 82 from static damage. FIGS. 6 and 7 show this arrangement, and further show a projecting tab that cooperates to ground any static charge to the chassis of printer 30.

Specifically, FIGS. 6 and 7 are end views of cover 75 in the closed and opened position, respectively. As shown in the closed position of FIG. 6, cover 75 includes projecting tab 80 which projects in non-contacting adjacency to carriage guide rod 69. Carriage guide rod 69 is metallic, and provides a ground path to the printer chassis. A gap 81 exists between tab 80 and guide rod 69. The size of gap 81 is selected to be small relative to the distance across which a static spark can jump, and preferably is on the order of 1 (one) mm. When gap 81 is so sized, it is smaller than the gap between an operator's finger and cover 75 when a potentially damaging static charge jumps from the finger to the cover (or jumps from the operator's finger to whatever structure of printer 30 that the finger is approaching). With a small gap 81, the static charge can jump across gap 81, thereby grounding the static charge and avoiding damage to alignment sensor 82 or to its leads.

In FIG. 7, cover 75 is shown in the open position. Because of hinging action around hinge 76, tab 80 is somewhat closer to carriage guide rod 69. However, gap 81 is sized sufficiently large so that even in the open position a gap 81*a* is maintained between tab 80 and guide rod 69, so that tab 80 is in non-contacting close adjacency to guide rod 69.

As further shown in FIG. 7, cover 75 includes a skirt 83 which completely surrounds sensor 82 even when the cover is hinged to the open position. Skirt 83 shields sensor 82 from ambient light conditions, thereby facilitating a more accurate sensing operation, and improving alignment results.

Figure 8:
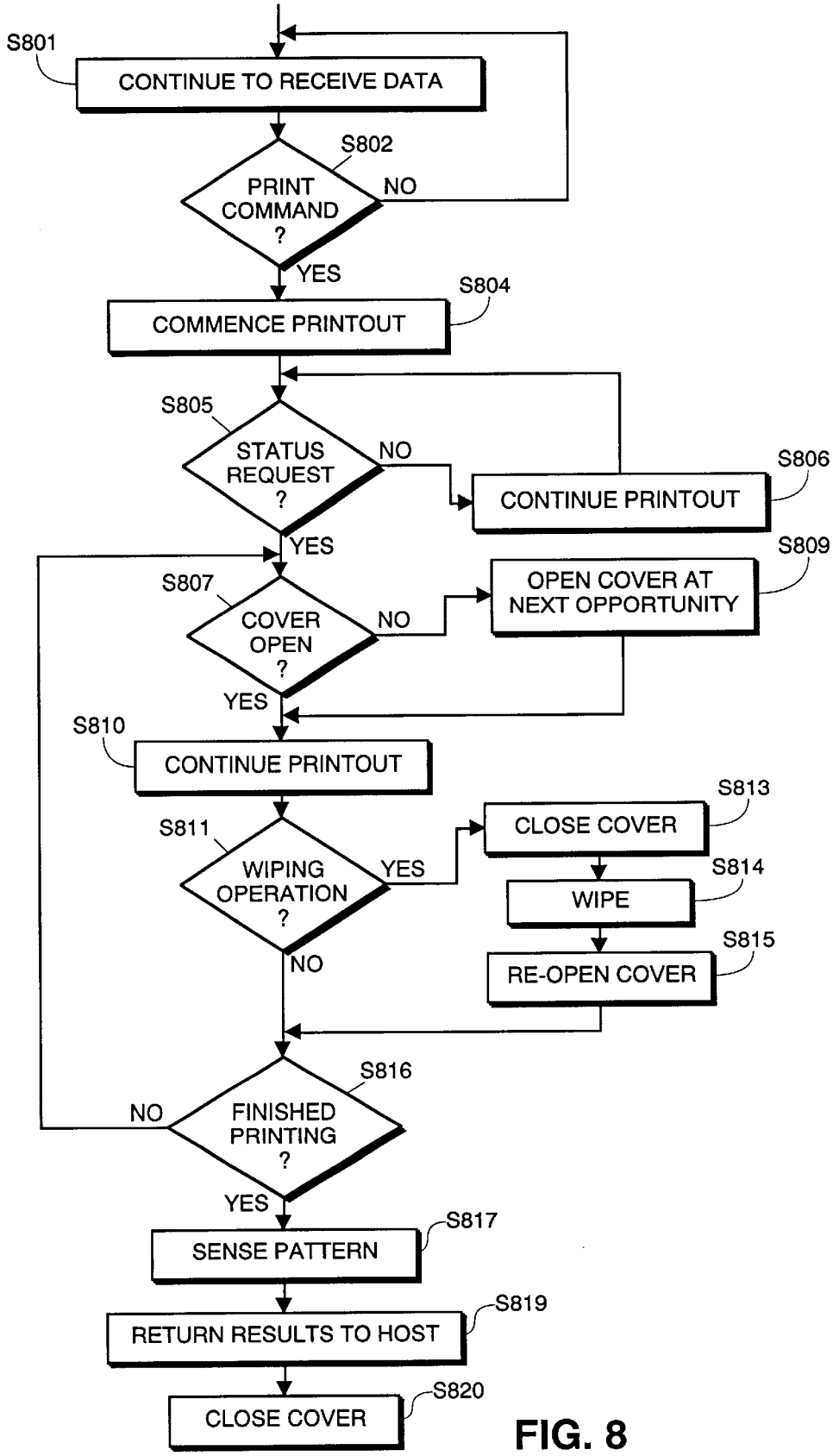
FIG. 8 is a flow diagram explaining opening and closing operation of the cover.

FIG. 8 is a flow diagram used for explaining operation of openings and closings for cover 75. Generally speaking, the process steps shown in FIG. 8 illustrate operation by which cover 75 is hinged between open and closed positions in response to reciprocal movement of printer carriage 64 to extreme positions 86 and 87. In particular, cover 75 is hinged to its open position at the first opportunity following receipt by printer 30 of a command to obtain alignment sensor data, even though potentially contaminating printout is still underway. Such printout may include printout of a predetermined alignment pattern; and in this case, hinging to an open position at the first opportunity following receipt of a command to obtain alignment data speeds overall operation, since there is no need to wait for the cover to be opened following completion of printout of the alignment pattern.

In addition, the process steps shown in FIG. 8 generally depict process steps by which the cover is deliberately closed in anticipation of other printer maintenance operations that potentially could damage the auto alignment sensor 82. In the situation described here, one potentially damaging operation is a wiping operation by wiping blades 83*a* and 83*b*. Wiping operations can occur at predetermined intervals that are independent of other operations of printer 30, and therefore might occur at a time when cover 75 is open. If cover 75 were open during a wiping operation, then wiping blades 83*a* and 83*b* might brush the surface of alignment sensor 82 or might otherwise cause significant quantities of ink to be deposited on the face of sensor 82. Consequently, cover 75 is deliberately closed in anticipation of a wiping operation, as well as in anticipation of any other operation such as ink pre-firing so as to clear nozzles that have the potential to damage sensor 82.

Generally speaking, and as described in the aforementioned application Ser. No. 08/972,139, printer 30 prints data such as predetermined alignment patterns and obtains alignment sensor information in response to commands from an unshown host computer. A [DATA] command includes print data that is stored by printer 30 in anticipation of printout. A [PRINT] command signifies that printer 30 should commence printout operations of the stored print data. A [STATUS REQUEST] command signifies that printer 30 should obtain alignment sensor data and transmit the sensor data to the host computer, so that the host computer can process the alignment data into alignment calibration parameters.

Thus, reverting to step S801 of FIG. 8, it is assumed that a [DATA] command has issued from the host computer, and that printer 30 continues to receive print data. In response to a [PRINT] command, step S802 advances flow to step S804 in which printer 30 commences printout of the received print data. It should be noted that printer 30 can continue to receive print data even after receipt of a print command.

Step S805 tests whether a [STATUS REQUEST] command has issued. Until a [STATUS REQUEST] command has issued, printer 30 simply continues printout (step S806).

In response to receipt of a [STATUS REQUEST] command, flow advances to step S807, in which printer 30 determines whether cover 75 is open or closed. Such a determination can be made by reference to an internally-maintained flag that stores the current state of the cover. If the cover is not open, then flow branches to step S809 in which printer 30 opens cover 75 at the next opportunity for doing so. Preferably, the next opportunity for doing so would include a situation in which carriage 64 is already close to an extreme leftward position of the print mediums, so that opening of cover 75 can be accomplished by simply extending movement of carriage 64 to the extreme position 86, for engagement of tab 70 with cover 75. In this situation, opening of cover 75 can be accomplished quickly and efficiently. In any event, flow proceeds with step S810 in which printer 30 continues printout of print data. During any printout printout in which cover 75 is open, however, if printer 30 undertakes an operation that is potentially damaging to alignment sensor 82, then step S811 and steps S13 through S815 operate to deliberately close cover 75 in anticipation of the operation, and re-open the cover when the operation has been completed. In the example given here, the potentially damaging operation is a wiping operation of the print heads by wiping blades 83*a* and 83*b*.

Thus, if in step S811 the printer 30 is undertaking a wiping operation, then flow branches to step S813 in which printer 30 deliberately closes cover 75. Closing of cover 75 is accomplished by moving carriage 64 to the extreme position 86, so that cover 75 engages with plate 71. Thereafter, following deliberate closure of cover 75, the wiping operation is accomplished in step S814. Following completion of the wiping operation, cover 75 is re-opened in step S815 by moving carriage 64 to extreme position 86 so that tab 70 can engage cover 75.

Flow advances to step S816 which returns flow to step S807 until printout is finished. When printout is finished, flow advances to step S817 in which printer 30 performs a sensing operation by moving carriage 64 with cover 75 in its open position, past the printed alignment pattern. Step S819 returns the alignment sensor results to the host computer, and step S820 closes the cover.

The invention has been described with respect to particular illustrative embodiments. It is to be understood that the invention is not limited to the above-described embodiments and that various changes and modifications may be made by those of ordinary skill in the art without departing from the spirit and scope of the invention.

What is claimed is:

1. A cover for an alignment sensor in an ink jet printer that includes a carriage for reciprocally moving across a printing width during a printing operation and on which multiple print heads are removably mountable, an alignment sensor mounted on said carriage in a sensing direction that senses a predetermined alignment pattern printed by the multiple print heads, and an engaging member being operable to move said cover from an open position to a closed position and from a closed position to an open position, said cover comprising:

a shield for covering a sensing face of said alignment sensor; and a mounting for mounting said cover to said carriage, wherein said cover is moveable between the open position, in which said alignment sensor is operable to sense the predetermined alignment pattern, and the closed position, in which said cover protects the sensing face of said sensor, the cover being opened and closed based on movement of said carriage, and the cover being in the closed position except during a period in which the alignment sensor is operable to sense the alignment pattern.

2. A cover according to claim 1, wherein said cover includes a lower lid that in the open position is moved away from the alignment face so that said alignment sensor can perform a sensing operation.

3. A cover according to claim 1, wherein said cover includes a projecting finger that includes retaining means for retaining said cover in one of the open and closed positions.

4. A cover according to claim 1, wherein the carriage is moved to one extreme position outside a normal printing width to open said cover and to an opposite extreme position outside the normal printing width to close said cover.

5. A cover according to claim 1, wherein said cover includes a skirt which is adapted to shield said alignment sensor from ambient light while said cover is in the open position.

6. A cover according to claim 1, wherein said cover is comprised by a electrically conductive material, and further includes a projecting tab for grounding said cover to a chassis of the printer.

7. A printer comprising:

a printer chassis including a carriage guide member extending across a printing width;

a printer carriage mounted for reciprocal left and right movement on said guide member, said printer carriage having multiple print head receiving stations for removable receiving multiple print heads, wherein the print heads are adapted to be operated so as to print out a predetermined alignment pattern on a recording medium in a normal print width of said printer;

an alignment sensor mounted on said carriage with an alignment face thereof directed in a direction adapted to sense the predetermined alignment pattern;

an alignment sensor cover mounted to said printer carriage and adapted to be moved from an open position in which the alignment face of said alignment sensor is operable to sense the predetermined alignment pattern, and a closed position in which the alignment face of said alignment sensor is covered; and engaging means mounted on said printer chassis, said engaging means being operable to move said cover from an open position to a closed position and from a closed position to an open position in response to reciprocal movement of said printer carriage, the cover being in the closed position except for a period in which the alignment sensor is operable to sense the alignment pattern.

8. A printer according to claim 7, wherein said cover includes a lower lid that in the open position is moved away from the alignment face so that said alignment sensor can perform a sensing operation.

9. A printer according to claim 7, wherein said cover retaining means for retaining said cover in one of the open and closed positions.

10. A printer according to claim 7, wherein said cover includes a skirt which is adapted to shield said alignment sensor from ambient light while said cover is in the open position.

11. A printer according to claim 7, wherein said cover is comprised by a electrically conductive material, and further includes a projecting tab for grounding said cover to said guide rod in non-contacting adjacency.

12. A printer according to claim 7, wherein said carriage is moved to one extreme position outside said normal printing width to open said cover and to an opposite extreme position outside the normal printing width to close said cover.

13. In a printer having multiple print heads and a cover for an alignment sensor that senses a print pattern from the print heads, a method for protecting the alignment sensor comprising the steps of:

opening the cover to perform a sensing operation;

while the cover is open, responding to a printing operation potentially damaging to the alignment sensor by deliberately closing the cover and thereafter re-opening the cover when the potentially damaging Drinting operation is complete;

performing the sensing operation; and closing the cover.

14. A method according to claim 13, wherein the potentially damaging printing operation includes a wiping operation for a print face of the multiple print heads.

15. A method according to claim 13, wherein the potentially damaging printing operation includes a pre-firing operation to clear ink ejection nozzles in the print heads.

* * * * *

UNITED STATES PATENT AND TRADEMARK OFFICE

CERTIFICATE OF CORRECTION

PATENT NO. : 6,250,735 B1
DATED : June 26, 2001
INVENTOR(S) : Kaneko et al.

It is certified that error appears in the above-identified patent and that said Letters Patent is hereby corrected as shown below:

Column 1,
Line 56, "auto alignment" should read -- auto-alignment --;
Line 62, "prevent" should read -- preventing --; and
Line 65, "object" should read -- object of --.

Column 2,
Line 4, "auto alignment" should read -- auto-alignment --.

Column 6,
Line 11, "printout" (second occurrence) should be deleted; and
Line 13, "S13" should read -- S813 --.

Column 7,
Line 14, "a" should read -- an --.

Column 8,
Line 13, "a" should read -- an --; and
Line 31, "Drinting" should read -- printing --.

Signed and Sealed this

Sixteenth Day of April, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,250,735 B1
DATED : June 26, 2001
INVENTOR(S) : Kaneko et al.

It is certified that error appears in the above-identified patent and that said Letters Patent is hereby corrected as shown below:

Title page,
Item [56] References Cited, under U.S. PATENT DOCUMENTS, insert the following:

| | | |
|---|---|---|
| --4,962,390 | 10/1990 | Yoshimura et al. --; and |
| 5,534,898 | 7/1996 | Kashino et al. -- |

Signed and Sealed this

Twenty-eighth Day of May, 2002

*Attest:*

*Attesting Officer*

JAMES E. ROGAN
*Director of the United States Patent and Trademark Office*